United States Patent [19]

Montabert

[11] 4,364,540

[45] Dec. 21, 1982

[54] SUPPORT-ARM ASSEMBLY FOR A DRILL OR BORER, PARTICULARLY FOR SUBTERRANEAN APPLICATIONS

[75] Inventor: Roger Montabert, Bron, France

[73] Assignee: Etablissements Montabert S.A., Saint-Priest, France

[21] Appl. No.: 133,829

[22] Filed: Mar. 25, 1980

[30] Foreign Application Priority Data

Mar. 26, 1979 [FR] France ..... 79 08169

[51] Int. Cl.[3] ..... F16M 1/00

[52] U.S. Cl. ..... 248/654; 173/43

[58] Field of Search ..... 248/654, 653, 652; 173/2, 38, 43, 35, 28

[56] References Cited

U.S. PATENT DOCUMENTS

| | | | |
|---|---|---|---|
| 830,586 | 9/1906 | Hamilton | 173/35 |
| 2,766,012 | 10/1956 | Hale | 173/43 |
| 3,481,409 | 12/1969 | Westerlund | 248/654 X |
| 3,565,184 | 2/1971 | Alvsjo et al. | 173/43 X |
| 3,721,304 | 3/1973 | Hanson | 173/43 X |
| 3,796,401 | 3/1974 | Mikhailovich | 173/43 X |
| 3,896,885 | 7/1975 | Dahlstrom et al. | 173/2 |
| 3,923,276 | 12/1975 | Kimber | 248/654 |
| 4,187,546 | 2/1980 | Heffernan et al. | 173/2 X |
| 4,232,849 | 11/1980 | Kimber | 248/654 |
| 4,266,749 | 5/1981 | Lundstrom | 173/38 X |
| 4,267,892 | 5/1981 | Mayer | 173/2 X |

FOREIGN PATENT DOCUMENTS

| | | | |
|---|---|---|---|
| 2000073 | 1/1979 | United Kingdom | 173/2 |

*Primary Examiner*—J. Franklin Foss

*Attorney, Agent, or Firm*—Karl F. Ross

[57] ABSTRACT

A mining drill comprising a rail along which a mining drill head is slidably rectilinear, this rail being carried by a hydraulic motor pivotally connected to a rotary head at the end of an arm swingable about a pivot axis which is generally horizontal and is formed by a column or post. A first hydraulic motor is provided to rotate the post about a generally upright axis and hydraulic cylinders can be provided to swing the post about a pivot close to its pedestal. The device is designed to support the rail so that substantially parallel holes can be drilled in a subterranean structure in practically any direction, e.g. with any inclination to the axis of the main gallery, but especially parallel thereto.

10 Claims, 5 Drawing Figures

SUPPORT-ARM ASSEMBLY FOR A DRILL OR BORER, PARTICULARLY FOR SUBTERRANEAN APPLICATIONS

FIELD OF THE INVENTION

The present invention relates to a support-arm assembly adapted to carry a rail for a drilling or boring apparatus. More particularly, the invention relates to drilling and boring apparatus of the type used to enlarge, advance or develop subterranean structures such as mine galleries, tunnels and the like, especially apparatus of the aforedescribed type having a rectilinearly extending guide element, hereinafter referred to as a rail, upon which a drilling tool or head can be shifted to drive a rod, bit or like drilling tool into the gallery wall.

BACKGROUND OF THE INVENTION

In all of the subterranean applications mentioned above, it is frequently desirable to provide a drill or boring machine which is capable of making relatively long holes or bores in a gallery wall or a rock structure forming a part of a subterranean excavation region. The bore or hole may receive an explosive charge for advancing the gallery, may be for the purpose of taking samples of the geological formations, may facilitate breaking up of material which has previously been separated from the wall, or may function itself as a means for weakening the wall or a mass of material so as to permit its further degradation.

For this purpose, various drill and borer structures have been provided heretofore.

The invention is particularly directed or concerned with machines for the purposes described which are capable of producing a plurality of parallel bores of considerable length along a gallery face to be advanced.

In recent years, it has been found to be advantageous to drill these holes substantially parallel to the gallery axis, i.e. generally horizontally since relatively long holes can be made, packed with the explosive, and used to separate more massive bodies of material in the direction of advance of the gallery. These systems are generally to be contrasted with systems in which the holes were drilled obliquely and in which the length of the hole was limited by the angle made by the axis of the drill with respect to gallery axis.

The rail or slide supports used heretofore for drilling applications have generally provided a parallelogrammatic linkage between the base and the rail, the parallelogrammatic linkage either utilizing a series of fixed mechanical links or a hydraulic system whereby fluid could be transferred from one cylinder to another. In either case, the parallelogram was of the so-called deformable type and had several significant disadvantages.

In the mechanical parallelogrammatic linkage, for instance, the direction in which the rail extended and hence the direction in which the holes were drilled, remained fixed. The apparatus had limited, if any, versatility and could not be used for anything else but simple advance of the gallery wall. However, the device was relatively simple and could produce bores which were parallel to one another with considerable accuracy.

In the case of purely hydraulic systems, there was a lack of precision in the parallelism between the holes drilled, i.e. the guide or rail could not be moved parallel to itself with sufficient accuracy. It may be pointed out that high precision in the drilling of parallel holes is a requirement when a large body of material is to be blasted loose in a subterranean system.

OBJECTS OF THE INVENTION

It is the principal object of the present invention to provide an improved arm-type support structure for a subterranean drilling or boring machine whereby the disadvantages enumerated above are eliminated.

Another object of the invention is to provide a subterranean drilling or boring machine having a rectilinear guide or rail for the drilling or boring head which can be oriented with high versatility in all directions and is able to be used for various mining purposes while at the same time having the facility of drilling, with considerable precision, a plurality of mutually parallel holes.

Yet another object of this invention is to provide an improved apparatus for carrying a drilling rail or guide such that the latter is moved with precise parallelism from place to place, i.e. can be displaced parallel to itself with high accuracy.

SUMMARY OF THE INVENTION

These objects and others which will become apparent hereinafter are attained, in accordance with the present invention, in an arm-type support for a rail which must be maintained parallel to itself for movement from place to place, which comprises a base pivot (column) rotatably mounted about a substantially vertical axis, a first motor means adapted to effect rotation of the base pivot about the aforesaid axis, an arm articulated to the base pivot about an axis perpendicular to the upright axis mentioned previously, a second motor means adapted to cause pivoting of the arm about its articulation axis on the base pivot, an intermediate support body disposed at a free extremity of the arm and rotatably mounted about the longitudinal axis of said arm, a third motor means adapted to cause rotation of this support body, a cradle supporting the rail and articulated on the aforementioned support body about an axis orthogonal to the longitudinal axis of the arm, and a fourth motor means adapted to cause pivoting movement of the cradle about its articulation axis.

The apparatus of the present invention comprises manual control means for actuating the first two motors and two position detectors adapted to produce control signals representing the two position parameters which result from the movement caused by the first two motors.

A slave or follower system (servomechanism) can be provided with calculator means determining continuously from these two parameters represented by the signals stated, the other parameters which are necessary to control the last two mentioned motors.

The four rotary movements which must be interrelated to permit the rail to move parallel to itself can thus be derived from two manually directed parameters and two parameters automatically calculated from those which are manually selected. The system has been found to provide a highly accurate positioning of the rail because the operator is only required to act upon the first two motor means which are connected to the manual actuating means such as distributing valves which operate the cylinders defining the values of the first two parameters. The slave or follower system automatically establishes the two other parameters and actuates the two last motor means as a function of these parameters, such as a rotary hydraulic motor and/or a hydraulic cylinder. The result is that the rail is maintained parallel to a fixed direction.

The parameters which are used are advantageously the angular displacements defined by the various rotary or pivoting movements or the trigonometric functions of these angular displacements.

BRIEF DESCRIPTION OF THE DRAWING

The above and other objects, features and advantages of the present invention will become more readily apparent from the following description, reference being made to the accompanying schematic drawing representing several embodiments of the invention and in which.

SPECIFIC DESCRIPTION

Figure 1:
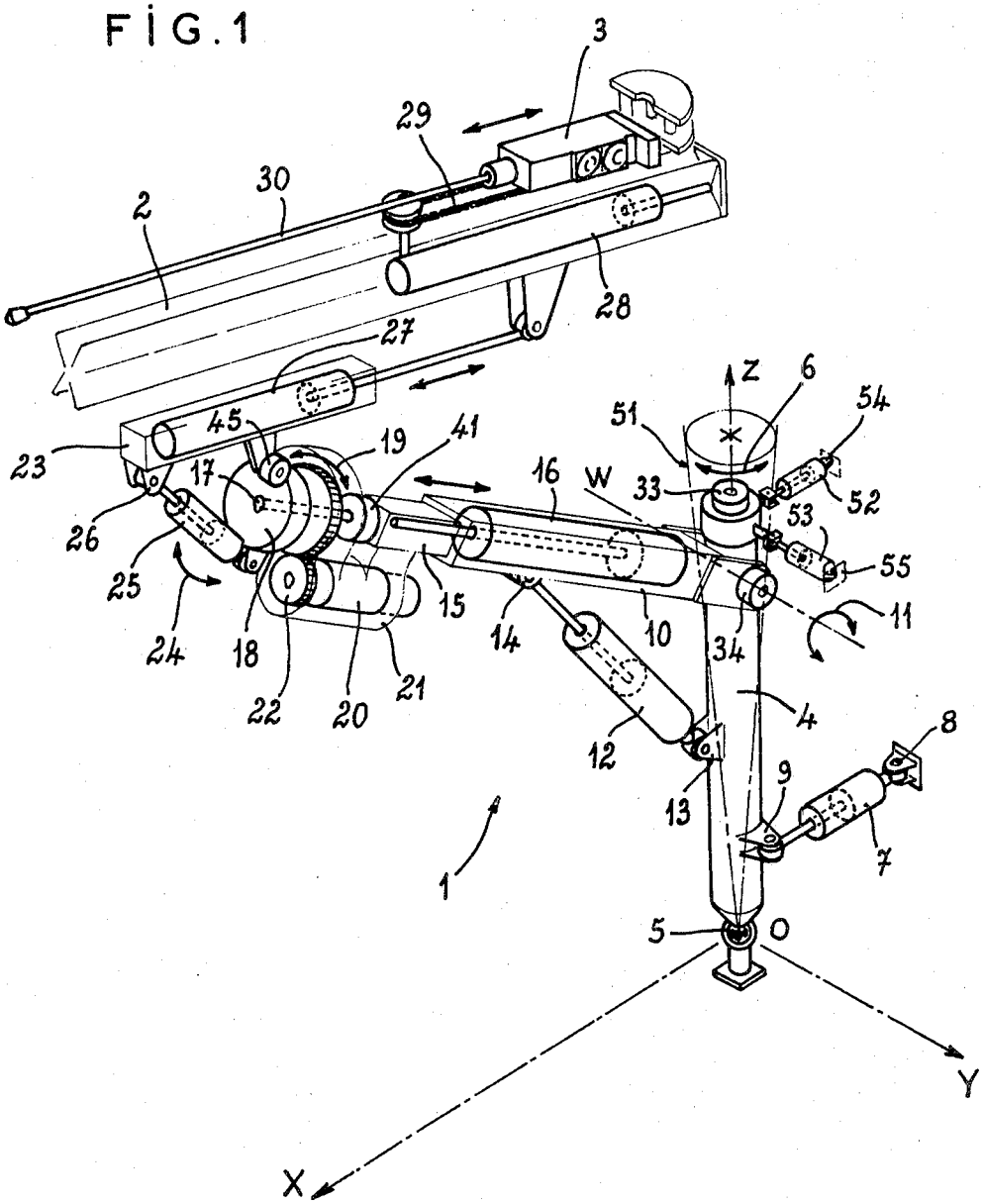
FIG. 1 is a perspective view, partly broken away, illustrating a first embodiment of a support-arm assembly according to the invention.

FIG. 1 shows a support-arm assembly according to the invention, represented generally at 1, and comprising a guide rail 2 defining a rectilinear path for a drill head 3 which is slidable along the rail and carries the drill bit 30.

The support-arm assembly 1 is mounted above a platform which may be self-propelled and has a chassis, not shown, upon which a pedestal is mounted. This carriage can contain the drive mechanism for advancing the assembly, the hydraulic reservoir, the various valves used to control the assembly, and the electrical power source. It also may be provided with the control system components described below and may be electrically powered or powered by a combustion engine. The carriage is displaceable substantially horizontally with movements along the axes OX and OY or with a resultant vector which can be resolved into components along these axes.

Axis OX can represent a direction parallel to the axis of the gallery which is to be advanced by the drilling of holes in the face of the gallery to receive explosives in the usual manner. The guide rail 2 can be positioned parallel to the axis OX and maintained in such parallelism.

The support-arm assembly 1 comprises a first part or post 4, referred to as a base pivot whose lower end is articulated upon a pedestal by a universal joint 5 which may be constituted by a ball-and-socket assembly. The pedestal, as noted, rests upon the chassis.

The base pivot has an upright that is rotatable about its axis OZ as represented by the arrow 6 under the control of a first cylinder 7 pivotally connected at 8 to some fixed reference point either on the vehicle or on the gallery wall. Its piston rod is pivotally connected by trunnions 9, projecting to one side of the post 4, to this base pivot.

At an upper part of this base pivot or piston 4, an arm 10 is pivotally mounted for swinging movement about an axis W perpendicular to the axis OZ and thus substantially horizontal. The pivoting of arm 10 about the axis W is represented by the arrow 11 and is controlled by a second cylinder 12.

This cylinder is pivotally connected to trunnions 13 projecting from the piston 4 at a location at right angles to the trunnions 9 and turned in the forward direction. The piston rod of this cylinder is pivotally connected to the trunnions 14 projecting from the underside of the arm 10.

The arm 10 carries a front arm member 15 with a telescopic structure. The effective length of this structure can be controlled by a telescopic cylinder 16 received within the arm. This enables the front end of member 15 to be displaced along the axis of the arm 10 toward and away from the piston 4.

At its front or free end, the front arm member 15 is provided with a shaft 17 extending along its longitudinal axis and receiving a rotatable intermediate head or body 18.

The rotation of the intermediate head 18, represented by an arrow 19, is controlled by a motor 20 which may be received in a casing 21 rigid with the front arm member 15 and coupled to the head 18 by a pair of meshing gears 22 as shown in FIG. 1. The head 19 can also be provided with a rotary electric and hydraulic coupling with a fluid distributor and a brush/sleeve ring arrangement of any conventional design to permit electrohydraulic signals to be transmitted through the head from the nonrotatable members of the assembly.

The head 18 also carries a cradle or like support structure 23 which is pivotally mounted on the head for tilting movement about an axis orthogonal to the longitudinal axis of the telescoping structure formed by the arms 10 and 15. The pivotal movement of the member 23 is represented by the arrow 24 and is controlled by a cylinder 26 pivotally connected to trunnions on the head 18 on the underside of member 23.

The rail 2 is connected to the member 23 by a further cylinder 27 referred to herein as an anchoring cylinder and which permits advance or retraction of the rail 2 parallel to itself, i.e. rectilinearly. To this end, the rail may have a pair of trunnions along its underside pivotally receiving the piston rod of cylinder 27 between them.

In a conventional manner with which this invention is not concerned, the rail 2 can be provided with yet another cylinder 28 which is designed to displace the drilling head 3 along the rail. For example, the cylinder 28 may be movable while its piston rod is fixed to the rail to shift a sprocket wheel to the left and to draw a chain 29 in this direction, the chain being connected to the head 3 so as to cause the displacement thereof. Other sprockets over which the chain may run have not been shown in the drawing.

The displacement of the head 3, of course, advances the drill rod 30 to drive the same into the wall of the gallery which lies in a plane parallel to the plane YOZ. The drill rod may be pneumatically, hydraulically or electrically rotated or impacted in a conventional manner.

In the embodiment described with reference to FIG. 1, the telescoping movement produced by the cylinder 16 precedes the rotary movement of the head 18 about the arrow 19. However, the order of these two movements can be reversed as has been represented in FIG.

2 in which similar reference numerals are used to designate similarly functioning parts. In this embodiment the rotary movement precedes the telescoping movement. Obviously, the concept of one movement preceding the other is not intended to indicate necessarily a sequence in time but rather indicates the kinematic (action) flow from the column 4 to the drilling head 3.

Figure 2:
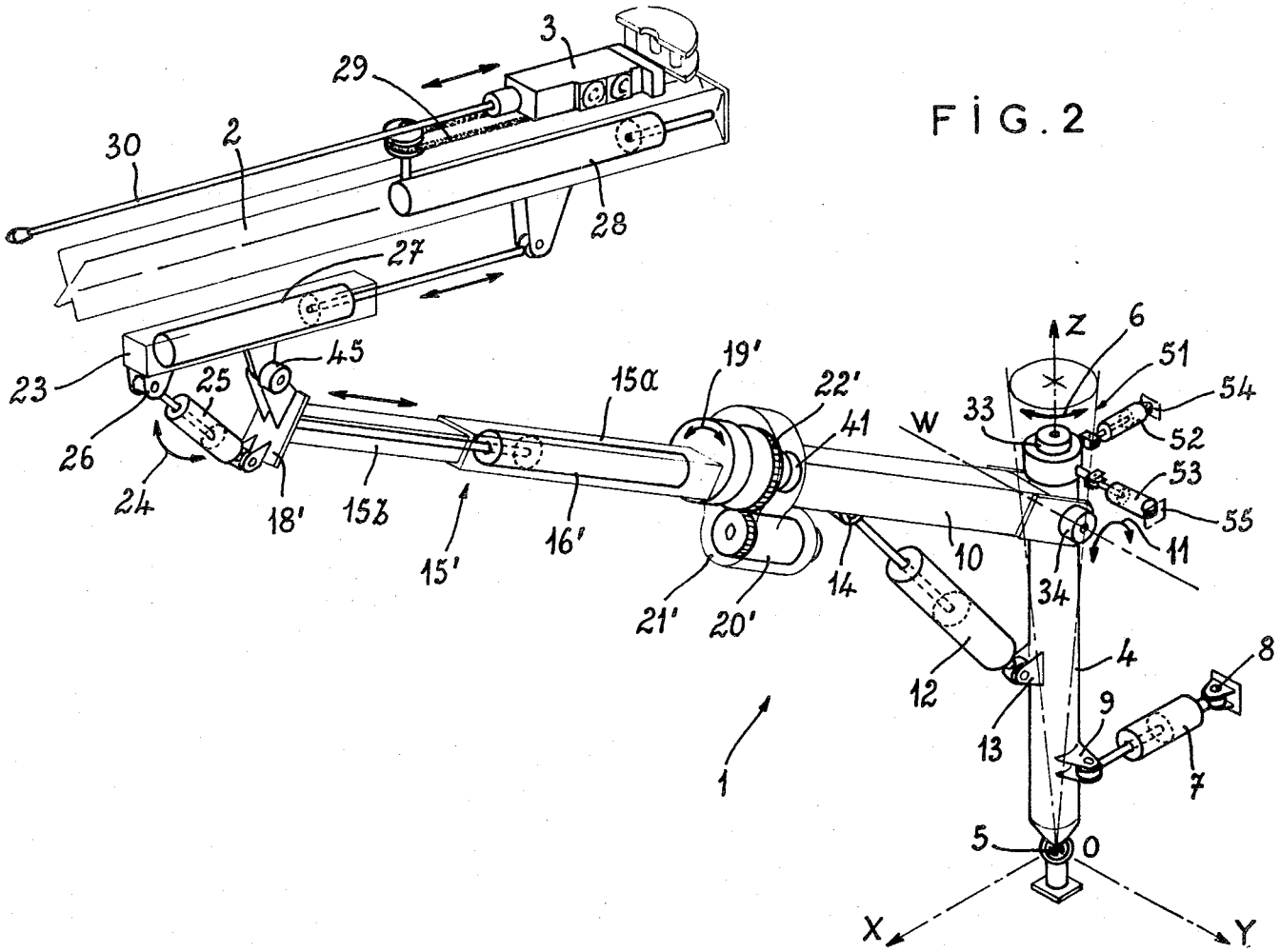
FIG. 2 is a similar view illustrating a second embodiment of the invention.

In the embodiment of FIG. 2, the construction of the column 4 and arm 10 with the cylinders 7 and 12 and associated parts for rotation about the arrows 6 and 11 are the same as the embodiment of FIG. 1.

Here, however, the front arm member 15' is mounted upon the rotary head at the fixed free end of the arm 10. This head is rotatable as represented by the arrow 19' by a motor 20' in a casing 21' rigid with the arm 10. In this embodiment as well the motor 20' is coupled with the head via gearing 22'.

The front arm member 15' is formed by two telescopingly interconnected elements 15*a* and 15*b*, the inner element 15*b* of which is slidably receivable in the element 15*a*. The effective length of the arm 15' can be varied by the telescoping cylinder 16' which functions in the manner described for the cylinder 16 previously.

The free end of element 15*b* is provided with a support plate 18' carrying the pivot 45 for the cradle or bar 23 which is provided with the cylinder 27 and carries the rail 2 in the manner described. Here the cylinder 25 for tilting member 23 about the pivot 45 is anchored to the lower part of the plate which constitutes the member 18'.

The pivot axis of member 23 is thus orthogonal to the longitudinal axis of the telescoping arm 15*a*, 15*b* and its pivotal movement, represented by the arrow 24, is induced by the cylinder 25.

In both the embodiments described, positioning of the rail 2 parallel to the direction OX at a given point in a plane parallel to the plane YOZ representing the drilling front (gallery face) can be effected by an operation involving four angular displacements represented by the respective arrows 6, 11, 19 (or 19') and 24.

Figure 3:
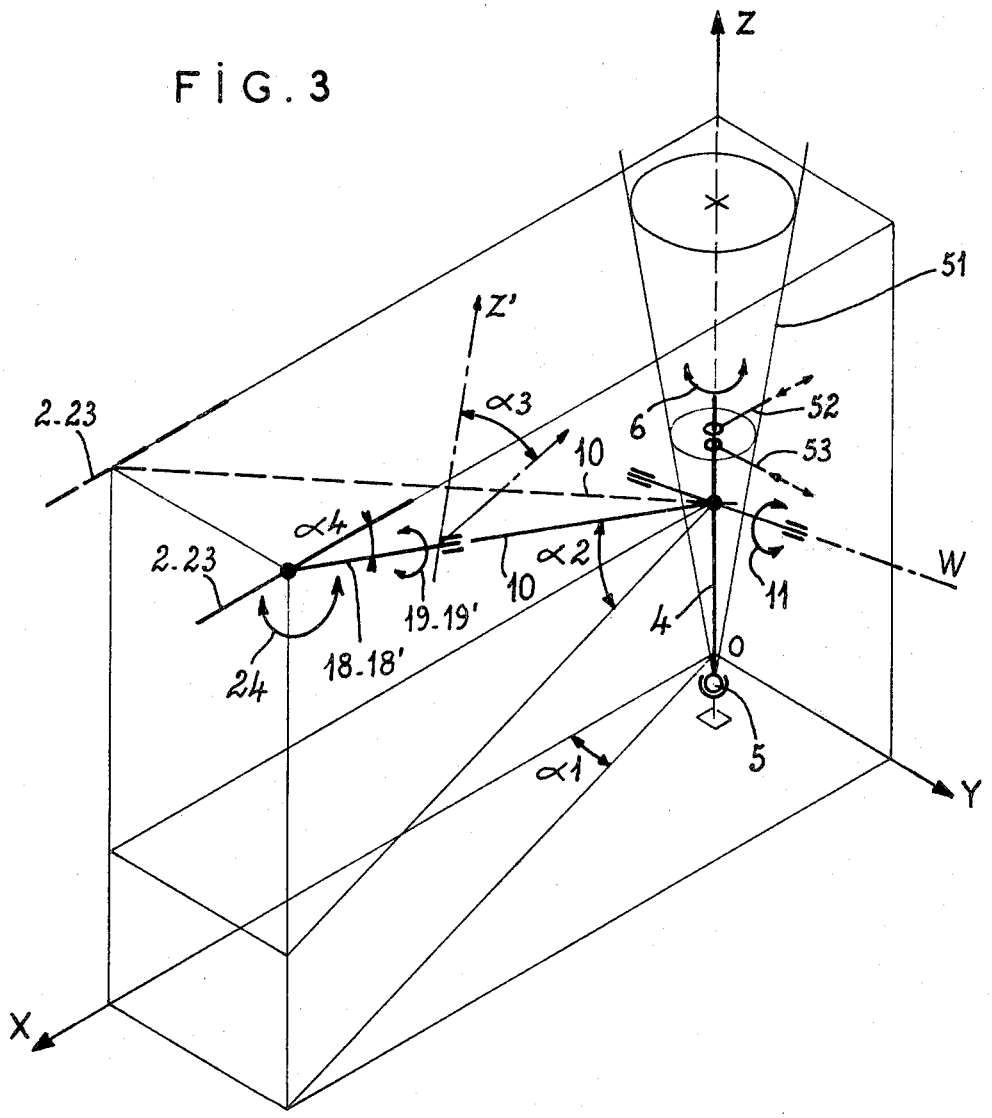
FIG. 3 is a diagram facilitating the definitions of the various angles referred to in the subsequent description and other parameters representing the movements of the support-arm assembly.

These movements are best described in terms of four angles as shown in FIG. 3 in which the structure of the support assembly has been indicated only schematically by heavy lines and circles for pivots.

The rotation of the pivot column 4 about the upright axis OZ is defined by a first angle $\alpha 1$. This angle $\alpha 1$ is also defined as the angle formed between the axis OX and the projection on the XOY plane of the arm 10.

Pivoting of the arm 10 about the axis W is defined by a second angle $\alpha 2$ which corresponds to the angle formed between the longitudinal axis of arm 10 and a plane parallel to the XOY plane.

Rotation of the support 18 or 18' about the axis Z (FIG. 3), an axis in the vertical plane through the arm 10 but perpendicular thereto, defines the angle $\alpha 3$.

Finally, the rotation of the rail carrier 23 and hence the rail 2 about its pivot axis (45) to the support 18 or 18' is defined by a fourth angle $\alpha 4$ which is simply the angle between the axis of arm 10 and the longitudinal dimension or axis of either rail 2 or of the arm carrier 23 parallel thereto.

Thus each position of the rail 2 corresponds to a set of predetermined values of the four angles $\alpha 1$, $\alpha 2$, $\alpha 3$ and $\alpha 4$, which are not modified by the telescoping movement.

If the rail 2 is to remain parallel to the axis OX (a given condition which is assumed for the purposes of this description), the four values are related by the following relationships:

$$\cos \alpha 4 = \cos \alpha 1 \cdot \cos \alpha 2 \quad \text{(I)}$$

$$\mathrm{tg}\,\alpha 3 = (\mathrm{tg}\,\alpha 1)/(\sin \alpha 2) \quad \text{(II)}$$

$$\sin \alpha 3 = (\sin \alpha 1)/(\sin \alpha 4) \quad \text{(III)}$$

These relationships involve trigonometric functions of the angles $\alpha 1$, $\alpha 2$, $\alpha 3$ and $\alpha 4$.

If the values of the two angles $\alpha 1$ and $\alpha 2$ are known, from these relationships it is possible to obtain the two other angles $\alpha 3$ and $\alpha 4$ utilizing, for example, the relationships I and II. This can be done automatically by a simple calculator which can include a microprocessor. Reference in this respect can be had to the electrohydraulic diagram shown in FIG. 4.

Figure 4:
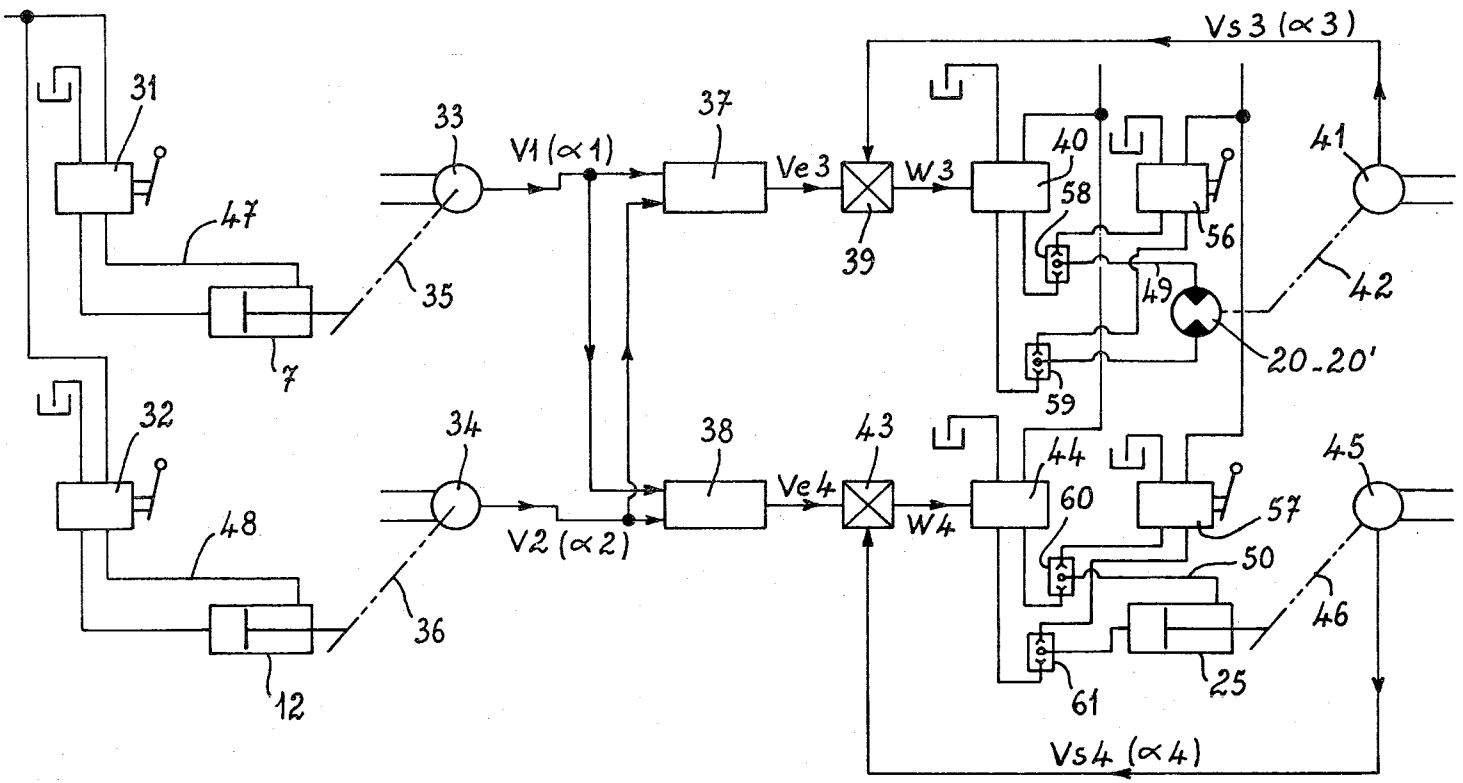
FIG. 4 is a hydraulic circuit diagram of the electrohydraulic system maintaining parallelism of the slide in accordance with one embodiment of the invention.

The control circuit of FIG. 4 for the device of either FIG. 1 or FIG. 2, comprises hydraulic distributing valves 31 and 32 which can be controlled individually and manually, and which serve to regulate the operation of the valves 7 and 12 to determine the rotation of the column 4 and the inclusion of the arm 10 (about pivots 6 and 11, respectively). The angles $\alpha 1$ and $\alpha 2$ are thus established by the operation of these cylinders 7 and 12 and hence by the operator.

The instantaneous values of angles $\alpha 1$ and $\alpha 2$ are detected by magnetic/electrical transducers of the position-detecting type (*Servomechanism Practice*, McGraw-Hill Book Co., New York, Second Edition, 1960, p. 44 ff.) represented at 33 and 34.

The first sensor 23, which can be located at the head of the column 4 (see FIGS. 1 and 2) is provided with a mechanical connection represented at 35 in FIG. 4 to the element displaced by the cylinder 7. It generates an electrical signal (voltage) V1 directly proportional to the value of the angle $\alpha 1$.

The second sensor or transducer 34, located for example at the pivot between arm 10 and column 4 (see FIGS. 1 and 2), has a mechanical connection represented at 36 in FIG. 4 with the element displaced by the cylinder 12. It provides an electrical signal V2 directly proportional to the instantaneous value of the angle $\alpha 2$. The two sensors 33 and 34 are preferably position-detecting instruments of the potentiometer, variable reluctance or like type. They can be of the conventional type described in the aforementioned copending application whose output signal values are directly proportional to the trigonometric functions of the measured angular displacement which are required for use in the relationships given above.

The control system also comprises two electronic regulating circuits 37 and 38 each of which receives both of the signal values V1 and V2 at their inputs, representing the angles $\alpha 1$ and $\alpha 2$.

The first circuit 37 delivers at its output an electrical signal Ve3, in the form of a voltage, and representing the value of the angle $\alpha 3$ calculated according to the relationship II previously described, i.e. forming the arc tangent of the quotient of angle $\alpha 1$ and a signal representing the sine of angle $\alpha 2$.

In a parallel manner, the second circuit delivers at its output an electrical signal value Ve4 in the form of a voltage which represents the value of angle $\alpha 4$ deduced from the input signals from the angles $\alpha 1$ and $\alpha 2$ by the relationship I, i.e. forms the arc cosine of the products of the cosine functions of $\alpha 1$ and $\alpha 2$. The circuit 38 is thus a multiplier.

The two calculating circuits 37 and 38 thus continuously produce outputs representing the values $\alpha 3$ and $\alpha 4$ as a function of the operator-selected angles $\alpha 1$ and $\alpha 2$ to maintain the orientation of the rail 2, upon displacement, parallel to itself.

A first servooperator 39, receiving the input Ve3 representing the angle $\alpha 3$ actuates a distributor valve 40 controlling the flow of fluid to the hydraulic motor 20 or 20' which angularly displaces the head 18 or the front arm member 15' with the support 18'. The hydraulic motor control system can use an operator as described at page 409 ff. of *Servomechanism Practice* and a motor of the type described at pages 390 ff. thereof.

A third sensor 41, whose mechanical connection is represented at 42 to the part displaced by the motor 20 or 20' produces an electrical output value in the form of a voltage Vs3 directly representing the angle $\alpha 3$ at each instant. The sensor 41 is mounted either on the shaft 17 carrying the head 8 (see FIG. 1) or at the junction of the arm 20 and the front arm member 15' (see FIG. 2). The signal Vs3 serves as a feedback signal which is applied to the operator 39 controlling the valve 40 by an error signal W3 representing the difference between the assigned value determined by signal Ve3 and the actual value represented by the signal Vs3.

In an analogous manner, a second operator 43 receiving the other signal Ve4 representing the angle $\alpha 4$ desired, operates a distributor valve 44 to control the feed of fluid to the cylinder 25, thereby pivoting the rail carrier 23.

A fourth sensor 45 at the pivot axis of this rail carrier 23 on the head 18 or in the support 18' has a mechanical connection represented at 46 with the part displaced by the cylinder 25. This detector 45 provides an electrical output signal such as a voltage Vs4 directly proportional to the instantaneous actual value of the angle $\alpha 4$.

The signal Vs4 is returned as an error signal to an input of the operator 43 so that the output or control signal W4 is a function of the difference between the instant setpoint value represented by the signal Ve4 and the actual signal value Vs4.

The hydraulic circuit elements 47, 48, 49 and 50, which supply the cylinders 7 and 12, the motor 20 or 20', and the cylinder 25, are of conventional design and are represented by symbols commonly used in the art.

If one views the operation of the system of FIG. 1 or FIG. 2 by the circuit of FIG. 4, one can see that the angular displacements brought about by motor 20 or 20' and the cylinder 25 automatically establish positions of the rail 2 parallel to itself upon displacement of elements by the cylinders 7 and 12.

The motor 20 or 20' and the cylinder 25 are thus here controlled in parallel without interaction between one movement and the other.

Figure 5:
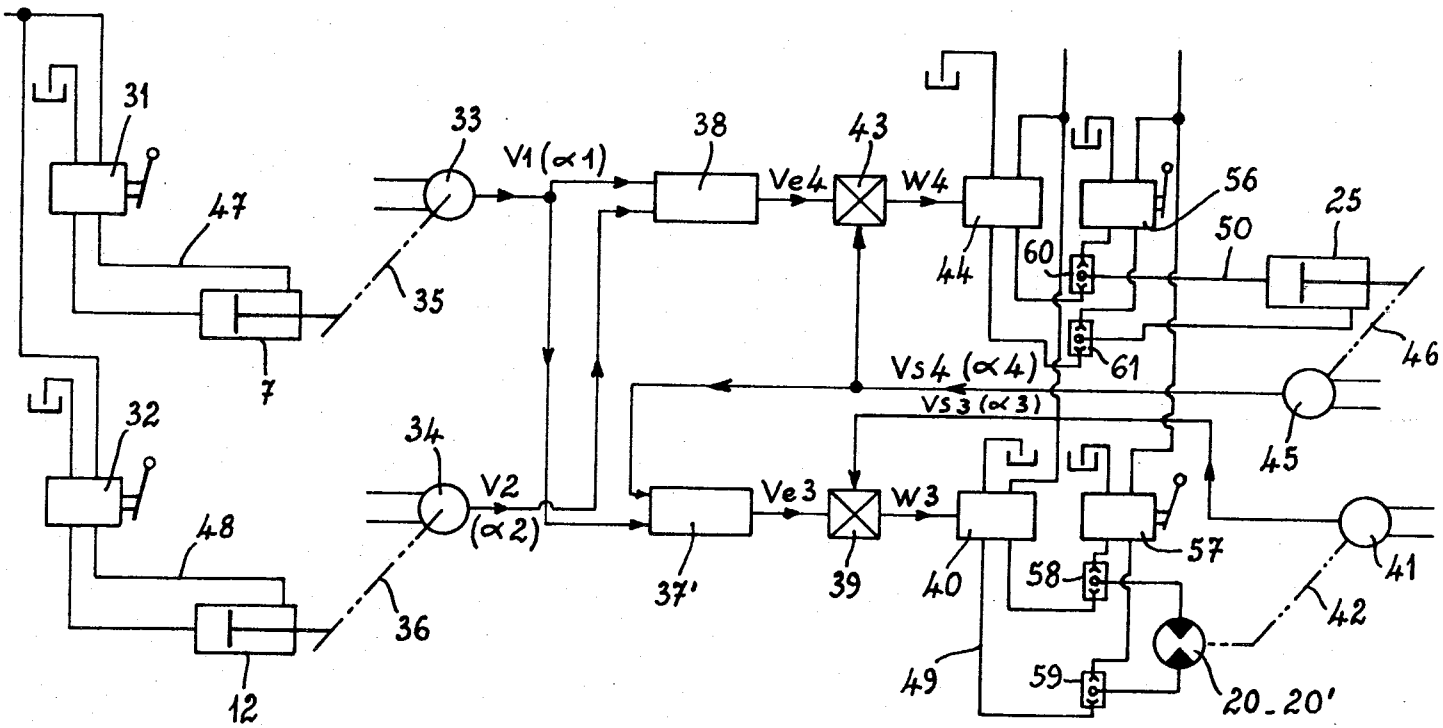
FIG. 5 is a similar diagram illustrating another embodiment of the electrohydraulic circuit for maintaining such parallelism.

An alternative system is shown in FIG. 5 wherein parts which are identical or correspond in function to those of FIG. 4 bear the same reference numerals.

Here the manually actuated valves 31 and 32, and the position detectors 33 and 34 which deliver the values V1 and V2 representing the angles $\alpha 1$ and $\alpha 2$ are the same as those which have already been described. Two calculating circuits 37' and 38 are also provided to determine the theoretical values of the other angles $\alpha 3$ and $\alpha 4$.

In this embodiment the signal V1 and the signal V2 of the angles $\alpha 1$ and $\alpha 2$, respectively, are applied to the two inputs of the circuit 38 which delivers, at its output Ve4 such a voltage representing the value of the angle $\alpha 4$ deduced from the values of angles $\alpha 1$ and $\alpha 2$ by the relationship I as described previously.

The circuit 38 thus determines continuously a value of the angle $\alpha 4$ as a function of the angles $\alpha 1$ and $\alpha 2$ and is required to maintain the displacement of the rail 2 parallel to itself.

As in the case of FIG. 4, the cylinder 25 is controlled by the circuit 38 by a feedback network including the operator 43 and a distributor valve 44 automatically controlled by this operator. The feedback circuit also includes a position detector 45 which provides a signal Vs4 directly proportional to the instantaneous actual value of the angle $\alpha 4$.

The circuit 37' receives as inputs, the value V1 representing angle $\alpha 1$ and value Vs4 representing the angle $\alpha 4$. Consequently, this latter signal is not only fed back to the operator 43 but also serves as an input signal for the circuit 37'.

The output signal Ve3 of the latter is thus calculated from the values $\alpha 1$ and $\alpha 4$ by the relationship given in equation III. Thus the circuit 37' is a dividing circuit which forms the arc sine of the quotient of sine values for the angles $\alpha 1$ and $\alpha 4$.

Here the value of the angle $\alpha 3$, which is a function of the values $\alpha 1$ and $\alpha 2$, is not calculated directly from these angles but rather is calculated after an intermediate determination of the value for the angle $\alpha 4$.

As in the case of the circuit of FIG. 4, the motor 20 or 20' is controlled by the output signal Ve3 through a feedback circuit including the operator 39, an automatic distributor valve 40 connected thereto, and a position detector 41 which provides the error signal Vs3 as an instantaneous value directly proportional to the angle $\alpha 3$.

It will be apparent, therefore, that the result obtained with the circuit of FIG. 5 is the same as that obtained with the circuit of FIG. 4 to ensure parallel displacement of the rail 2 to enable its translation upon extension of the arms.

The invention also provides means enabling adjustment of the rail 2 in an improved manner when the latter is to be positioned parallel to the axis of the gallery. It should be noted that the conventional means for controlling the rail or more than one rail of a drilling apparatus generally comprises a more complex arrangement of cylinders which must be braced against walls of the gallery and which frequently must be controlled by far more complex systems utilizing laser alignment, for example.

In the system of the present invention, the controller of each support structure of the present invention can permit parallel movement in a significantly simpler manner following the initial mounting and practically in any direction since the column 4 can be tilted so that the axis OZ can assume any position within the imaginary cone 51. Mechanically, selection of any position for the axis OZ within this cone is obtained by the use of two auxiliary hydraulic cylinders 52 and 53 which have an axis orthogonal (perpendicular) to one another and are pivotally connected between fixed points 54 and 55 and the top of the column 4. These two cylinders are actuated separately by independent control valves known in the art. The ball-and-socket joint 5 thus facilitates this control.

Another possibility for enabling control of the initial position of the rail with respect to the axis of the gallery is to permit the axis of the rail to be shifted utilizing different movements of the rail support assembly 1 without the automatic control system using, for example, a laser beam for alignment. Once the reference or initial position is established, manual control of the values V1 and V2 can be selected in order to provide automatic displacement with parallelism between successive positions of the rail.

In order to shift the rail as may be required for other drilling positions without parallelism, the operator imparts selected values to the parameters $\alpha 3$ and $\alpha 4$ which are independent of the values for $\alpha 1$ and $\alpha 2$. The feedback circuits are thereby cut out and the motor 20 (or 20') and the cylinder 25 are controlled by the two supplemental valves 56 and 57 which work through hydraulic circuit parameters 58 through 61 shown in FIGS. 4 and 5.

Each of the four rotary movements represented by the arrows 6, 11, 19 or 19', and 24 are able to be selected separately to permit direction of the rail as may be desired for any purpose, e.g. straight excavation, lateral excavation, attack upon dislodged matter, sampling or sounding, blasting or the like.

I claim:

1. A drilling machine comprising:

a column mounted for rotation about a substantially upright first axis;

first motor means connected to said column for angularly displacing same about said first axis with an angular displacement represented by the parameter $\alpha 1$;

an arm pivotally connected to said column at a second axis substantially perpendicular to said first axis;

second motor means connected between said column and said arm for angularly displacing said arm about said second axis, the angularly displacement of said arm about said second axis being represented as a parameter $\alpha 2$;

an intermediate support body carried by said arm;

third motor means connected between said support body and said arm for rotating said support body about a third axis generally perpendicular to said second axis with the angular displacement of said support body being represented by a parameter $\alpha 3$;

a rail support pivotally mounted on said support body and carrying a rail for a drilling head;

fourth motor means connected between said support body and said rail support for pivotally displacing said rail support relative to said support body through an angle represented by the parameter $\alpha 4$; and control means for said motor means including at least one manual control element operatively connected to said first and second motor means for actuating same, respective displacement detectors responsive to displacements produced by said first and second motor means for generating signals representing the parameters $\alpha 1$ and $\alpha 2$, and follower means connected to said displacement detectors and responsive to the parameters $\alpha 1$ and $\alpha 2$ for establishing continuously the values of the parameters $\alpha 3$ and $\alpha 4$ defining the orientation of said rail to maintain the same parallel to itself, and automatically controlling said third and fourth motor means in response to the parameters $\alpha 3$ and $\alpha 4$ calculated in the follower means.

2. The machine defining claim 1, further comprising telescoping means on said first arm for selectively displacing said fourth axis toward and away from said first axis without modifying the orientation of said rail.

3. The machine defined in claim 2 wherein said telescoping means includes a pair of telescopingly interconnected arm members connected to said support body and rotatable therewith.

4. The machine defined in claim 2 wherein said telescoping means includes a pair of telescopingly interconnected arm members interposed between said second axis and said support body.

5. The machine defined in claim 1, claim 2, claim 3 or claim 4 wherein said first and second motor means each is a respective hydraulic cylinder while said third and fourth motor means are a rotary hydraulic motor and a hydraulic cylinder, respectively.

6. The machine defined in claim 5, wherein said follower means comprises two calculating circuits each receiving at respective inputs, two voltage values V1 and V2 representing the parameters $\alpha 1$ and $\alpha 2$, respectively, each of said calculator circuits delivering at a respective output a signal of a value Ve3 and Ve4, respectively, representing the two other parameters $\alpha 3$ and $\alpha 4$, said third motor means being controlled in response to the value of signal Ve3, while said fourth motor means is controlled in response to the value of said signal Ve4 through respective feedback circuits each comprising a detector responsive to the displacement of the third motor means and the fourth motor means respectively.

7. The machine defined in claim 5, wherein said follower means comprises two follower circuits each delivering at a respective output, a value Ve3 and Ve4, respectively, representing the desired values of the parameters $\alpha 3$ and $\alpha 4$, said third motor means being responsive to the value Ve3 and said fourth motor means being responsive to the value Ve4 to respective feedback circuits including detectors responsive to the position changed by the third and fourth motor means respectively, the first of said calculator circuits being connected to receive at its inputs two values V1 and V2 representing the parameters $\alpha 1$ and $\alpha 2$, the other calculator circuit receiving at inputs a value V1 representing the parameter $\alpha 1$ and a value Vs4 produced by the detector responsive to said fourth motor means and representing an actual value of the parameter $\alpha 4$.

8. The machine defined in claim 5, further comprising means for disconnecting said follower means and independently controlling said third and fourth motor means.

9. The machine defined in claim 5, further comprising a ball-and-socket joint disposed between the bottom of said column and a pedestal, and a pair of hydraulic cylinders having mutually octagonal axes connected to said column for displacing same about a pivot point defined by said ball-and-socket joint.

10. A drilling maching comprising:

a column mounted for rotation about a substantially upright first axis;

first motor means connected to said column for angularly displacing same about said first axis with an angular displacement represented by the parameter $\alpha 1$;

an arm pivotally connected to said column at a second axis substantially perpendicular to said first axis;

second motor means connected between said column and said arm for angularly displacing said arm about said second axis, the angular displacement of said arm about said second axis being represented as a parameter $\alpha 2$;

an intermediate support body carried by said arm;

third motor means connected between said support body and said arm for rotating said support body about a third axis generally perpendicular to said second axis with the angular displacement of said support body being represented by a parameter $\alpha 3$;

a rail support pivotally mounted on said support body and carrying a rail for a drilling head;

fourth motor means connected between said support body and said rail support for pivotally displacing said rail support relative to said support body through an angle represented by the parameter $\alpha 4$;

control means for said motor means including at least one manual control element operatively connected to said first and second motor means for actuating same, respective displacement detectors responsive to displacements produced by said first and second motor means for generating signals representing the parameters $\alpha 1$ and $\alpha 2$, and follower means connected to said displacement detectors and responsive to the parameters $\alpha 1$ and $\alpha 2$ for establishing continuously the values of the parameters $\alpha 3$ and $\alpha 4$ defining the orientation of said rail to maintain the same parallel to itself, and automatically controlling said third and fourth motor means in response to the parameters $\alpha 3$ and $\alpha 4$ calculated in the follower means;

telescoping means on said first arm for selectively displacing said fourth axis toward and away from said first axis without modifying the orientation of said rail, said first and second motor means each being a respective hydraulic cylinder, said third and fourth motor means being a rotary hydraulic motor and a hydraulic cylinder, respectively;

means for disconnecting said follower means and independently controlling said third and fourth motor means; and a ball-and-socket joint disposed between the bottom of said column and a pedestal, and a pair of hydraulic cylinders having mutually orthogonal axes connected to said column for displacing same about a pivot point defined by said ball-and-socket joint.

* * * * *